US007140289B1

(12) United States Patent
Ansay et al.

(10) Patent No.: US 7,140,289 B1
(45) Date of Patent: Nov. 28, 2006

(54) STACKABLE IN-LINE UNDERWATER MISSILE LAUNCH SYSTEM FOR A MODULAR PAYLOAD BAY

(75) Inventors: Michael T. Ansay, Johnston, RI (US); Harry Zervas, Lincoln, RI (US); Michael J. Wroblewski, Portsmouth, RI (US); James T. Broadmeadow, Seekonk, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/985,083

(22) Filed: Nov. 8, 2004

(51) Int. Cl.
*F41F 3/00* (2006.01)

(52) U.S. Cl. ..... 89/1.809; 89/1.8; 89/1.815; 114/316; 114/319

(58) Field of Classification Search ..... 89/1.8, 89/1.801, 1.804, 1.805, 1.809, 1.81, 1.815; 114/316, 318, 319, 320; 244/63
See application file for complete search history.

(56) References Cited

U.S. PATENT DOCUMENTS 3,088,374 A * 5/1963 Guyant et al. ..... 89/1.81
3,137,203 A 6/1964 Brown
3,279,319 A 10/1966 Semonian et al.
3,499,364 A * 3/1970 Ooge ..... 89/1.81
4,147,124 A 4/1979 Brooks et al.
4,878,416 A 11/1989 Orquera et al.
5,170,005 A 12/1992 Mabry et al.
5,438,906 A 8/1995 Huber
6,164,179 A 12/2000 Buffman

* cited by examiner

*Primary Examiner*—J. Woodrow Eldred
(74) *Attorney, Agent, or Firm*—James M. Kasischke; Michael P. Stanley; Jean-Paul A. Nasser

(57) ABSTRACT

An underwater missile launch system includes one or more missile loading modules for supporting a plurality of missiles disposed within protective capsules in a stackable, in-line configuration within a pressure vessel. The missiles are arranged inside the modules, which may be stacked in groups inside a single pressure vessel, or payload bay. Each module is preferably substantially identical including a common size, shape, and payload of missiles in common with the module above and below it. A one-way positioning latch is provided that prevents the upper missiles from dropping down on top of the lower missiles, while allowing the lower missiles to later pass up through the same launch tube as the upper missiles, after the upper missiles have been ejected.

19 Claims, 3 Drawing Sheets

STACKABLE IN-LINE UNDERWATER MISSILE LAUNCH SYSTEM FOR A MODULAR PAYLOAD BAY

STATEMENT OF GOVERNMENT INTEREST

The invention described herein may be manufactured and used by and for the Government of the United States of America for Governmental purposes without the payment of any royalties thereon or thereto.

BACKGROUND OF THE INVENTION

1. Field of the Invention

The present invention relates to an underwater launch system for launching missiles or weapons, vehicles, countermeasures, etc. from an underwater vehicle, and more particularly a stackable, modular missile launch system for launching numerous small scale missiles from submarine payload bays.

2. Description of Prior Art

Traditionally, submarines have been provided with the capability of launching air borne vehicles, such as missiles, both through vertical launch via specialized launch tubes on the submarine, and horizontal launch via the submarine's torpedo tubes. In some cases, the missiles are quite large, such as the Tomahawk missile, which requires sufficient support for the large warhead on deployment.

Other smaller missiles have been developed which can be used against air borne targets, such as helicopters. However, these missiles have not been deployed from submarines because of launching considerations, such as the ability to launch multiple missiles. U.S. Pat. No. 6,164,179 to Buffman discloses a submarine deployable vertical launch spar buoy for launching small air nautical vehicles from submerged vehicles or platforms.

Existing submarine missile launch systems only have the ability to launch one missile from a single missile tube. If additional missile launches are required they must be fired from other independent missile tubes. The additional missile tubes are typically positioned side-by-side, adjacent to one another. The missile tubes are not positioned above each other, because the upper missile tube would block the lower missiles from launching. The current side-by-side configuration has a low packing density because of the individually dedicated missile tubes and pressure vessels required for each missile that is to be launched.

Accordingly, there is needed in the art a weapon launching system which increases packing densities to allow submarines to carry larger payloads of missiles while being low in cost to construct and operate, reliable, easy to maintain, and safe. Preferably, the weapon launching system should also be simple in design, relatively lightweight, and compact.

SUMMARY OF THE INVENTION

The present invention is directed to an underwater missile launch system including one or more missile loading modules for supporting a plurality of missiles in a stackable, in-line configuration within a pressure vessel. The missiles are each preferably arranged inside a protective capsule that is disposed within the launch tubes in the module. The modules may be installed in groups inside a single pressure vessel, or payload bay. A single modular group may be used alone, or multiple groups may be placed in a stacked arrangement, one on top of the other, two or more in height.

Preferably, each module is substantially identical including a common size, shape, and payload of missiles with the module above and below it. A one-way positioning latch is provided that prevents the upper capsules from dropping down on top of the lower capsules while allowing the lower capsules to later pass up through the same launch tube as the upper capsules, after the upper capsules have been ejected. The missile modules and capsules are enclosed within a watertight, payload pressure vessel or bay, which protects them from the ocean environment, and may preferably be ejected by a water pump positioned at the base of the vessel.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DESCRIPTION OF THE PREFERRED EMBODIMENTS

Figure 1:
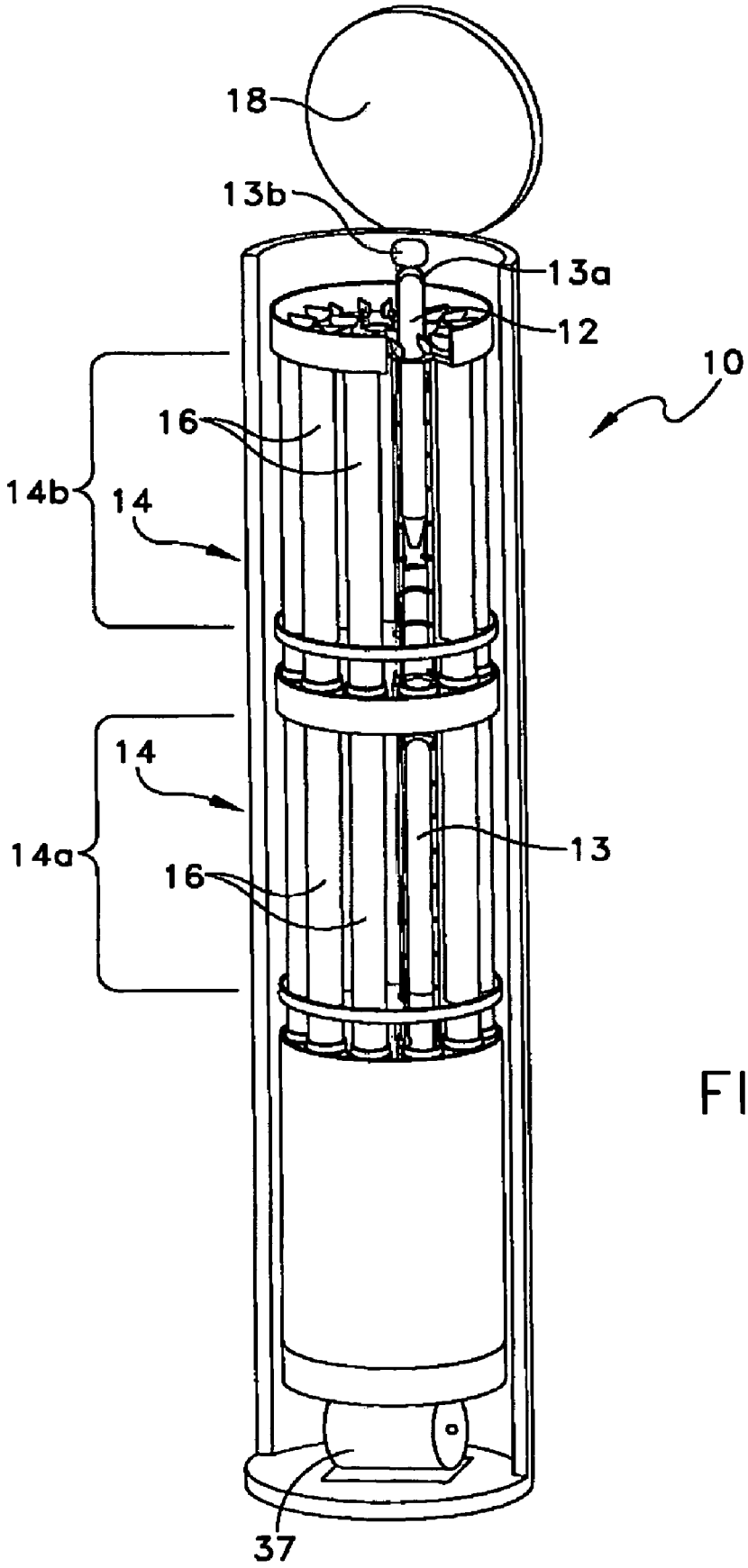
FIG. 1 is a perspective view of a missile module for the stackable, surface missile launch system according to the present invention.
Figure 2:
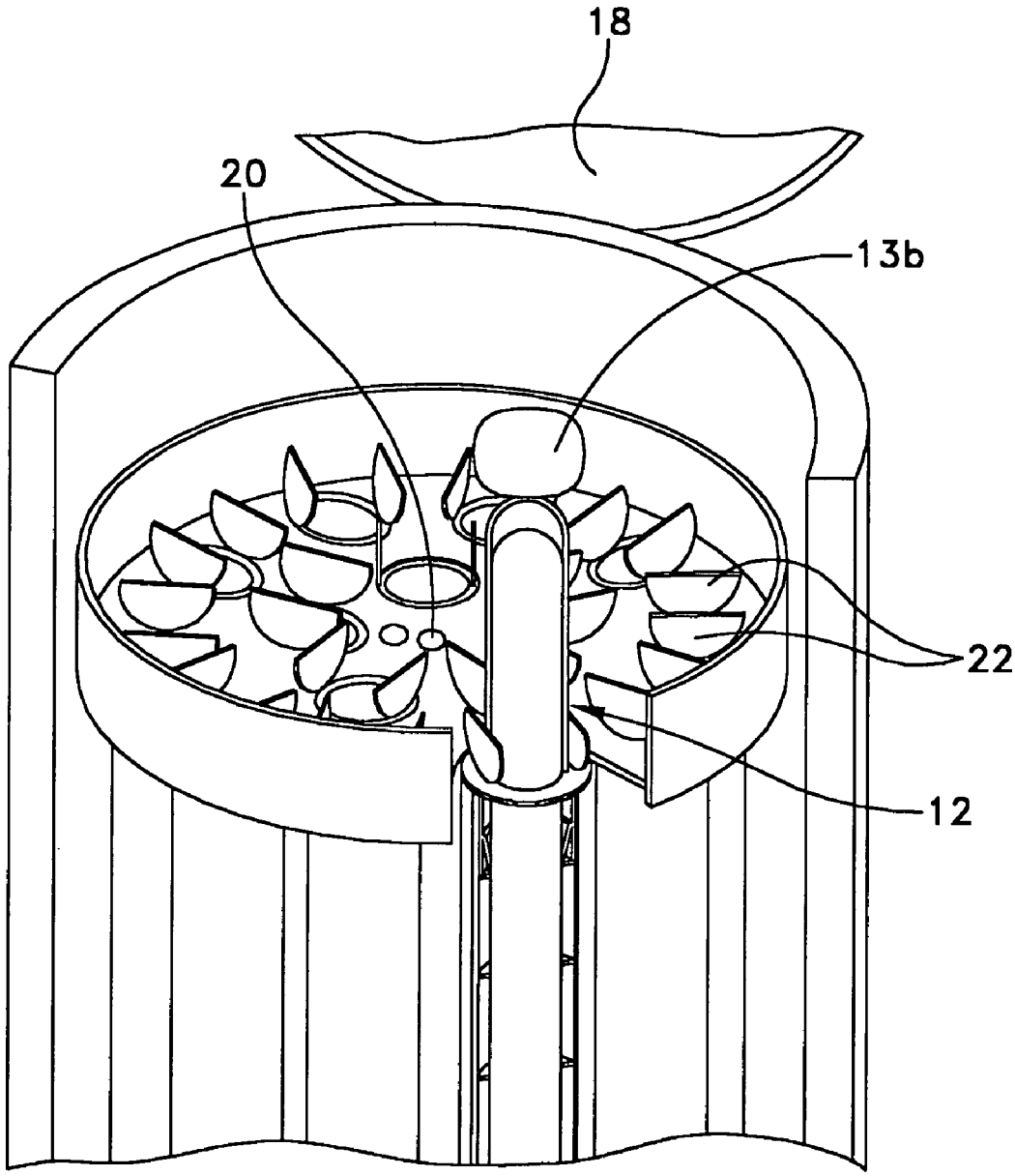
FIG. 2 is an enlarged perspective view of the launch end of the missile module of FIG. 1 showing the protective capsule.
Figure 3:
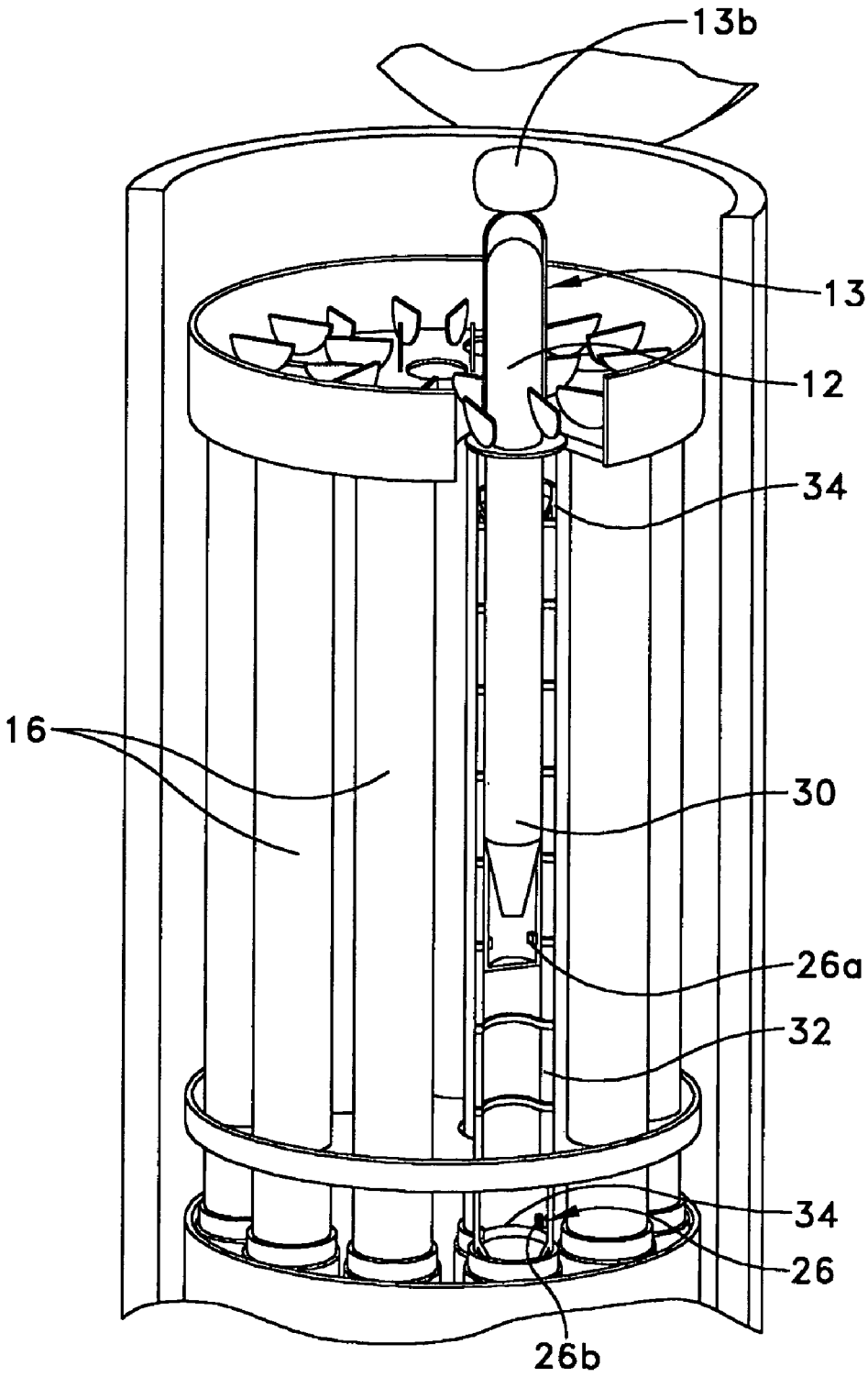
FIG. 3 is an enlarged perspective view of the launch end of the missile module of FIG. 1 including the protective capsule.

Referring now to the Figures, a payload pressure vessel 10 for supporting and launching a plurality of missiles 12 in a stackable, in-line configuration, from an underwater vehicle such as a submarine is illustrated. Each pressure vessel may preferably contain one or more missile modules 14, each module including multiple launch tubes 16, and each launch tube housing at least one protective missile capsule 13 for supporting a missile 12 therein. The modules may be used alone or in groups stacked two or more high. The height of the pressure vessel 10 determines the number and height of modules that can be stacked one on top of the other.

The pressure vessels 10 are preferably watertight and act to protect the missile modules 14 and missiles 12 from long-term exposure to corrosive seawater and from high depth pressures. The pressure vessel 10 remains closed with a watertight seal as the submarine maneuvers through the ocean environment. One or more lip seals 34 are preferably placed inside the launch tube of each missile module. The lip seals 34 are designated to seal against the upper and lower portions of the missile capsule 13 and limit the amount of pressurized water that leaks past the missile capsule 13 during the ejection. The seals 34 may preferably be spaced vertically such that at least one seal always remains in contact with the missile capsule 13 during ejection. A bay door or hatch 18 is positioned at the upper or launch end of the vessel and remains closed until ejection of the capsule 13 is initiated. The interior of the pressure vessel 10 is preferably filled with low pressure air.

Each missile module 14 preferably has a common size, shape, and payload of missiles 12 as the modules disposed above and below it, and are substantially identical in construction. Each module 14 also preferably includes a common connection for power, communications, piping, and missile alignment, all of which are well known in the art. When stacked two or more high, the missile launch tubes 16 of stacked modules 14 are connected and sealed to form a single long continuous missile tube 16. Flexible seals may be used at the base of each missile module 14 and launch tube 16 to minimize the mechanical connection requirements. Each launch tube 16 within a modular group preferably has the same height, and is vertically positioned to create a concave, or bowl shape at the top of the module. The bowl shape acts as a funnel to assist in draining seawater that may accumulate toward the middle of the module 14 where a drain 20 may preferably be located. The concave shape and drain 20 prevent standing seawater from collecting at the top of the module and from leaking onto the missiles 12.

Launch tubes 16 may each preferably include a hinged muzzle closure 22 disposed at the top, or launch end, which acts as a check valve to limit the amount of seawater that drains into the missile capsules 13, and other internal missile tube 16 hardware during use. The muzzle closure 22 also acts to protect and seal the missiles 12 disposed in a first or lower module 14*a* from the high-pressure water used to launch the missiles 12 above it in a second or upper module 14*b*, by preventing the build up of water inside the launch tubes 16. Longitudinal gaps may also be provided along the length of the launch tubes 16 in order to allow a sufficient amount of water to pass by the capsules 13. Any excess water will fill the air space above the capsule 13 while equalizing in pressure and forcing the hinged muzzle closure 22 open as the missile approaches the top of the launch tube 16. If the closure 22 is not open by the force of water, it is free to open in the direction of capsule 13 ejection as the capsule 13 makes contact with the muzzle closure 22. After a capsule has been ejected, a light torsion spring (not shown) and gravity are preferably utilized to close the hinged muzzle 22 in order to protect the remaining internal components of the launch tube 16, such as the shock mitigation material 32 and the latching mechanism, described below.

A latching mechanism 26 is used to position the capsule 13 inside the modular launch tube 16 and is preferably designed as part of the capsule 13. The latching mechanism 26 may preferably include a hinged portion 26*a* supported on the capsule 13, and a stop mechanism 26*b* supported on an interior surface of the launch tube 16. As the capsule 13 is loaded into a launch tube 16, it is lowered to the point where the latching mechanism 26 engages the capsules 13. The latching mechanism 26 acts to prevent the capsule 13 from dropping further down inside the launch tube 16. The latching mechanism 26 is automatically released as the capsule 13 is forced upwards. As will be appreciated, the latching mechanism 26 allows the capsule 13 to move upward, in the intended direction of ejection, but not downward. The hinged portion 26*a* preferably folds down to conform to the outside diameter of the capsule 13, so that the latching mechanism 26 will not interfere with the internal tube hardware as the capsule 13 is ejected. The hinged portion 26*a* of the latching mechanism 26 may preferably be discarded with the capsule 13 while the stop mechanism 26*b* preferably remains as part of the launch tube 16.

In the present embodiment, each missile 12 is preferably protected from launch depth pressure, seawater corrosiveness, and any damaging pressure differentials by a corresponding water tight capsule 13. Each capsule 13 preferably includes a body portion sized to receive a missile and a detachable nose cone 13*a*. Capsules 13 also provide an interface between the missile 12 and the launch tube 16 and can be utilized as storage and handling containers for the missiles 12. In use, the missile 12 remains within its protective capsule 13 as the capsule 13 is ejected from the launch tube 16 and ascends to the ocean surface. Depending on the weight of the missile 12, either the capsule 13 itself or an expandable buoyancy device 13*b*, such as an inflatable airbag, may be used to float the capsule 13 and missile 12 to the ocean surface, as is known in the art. Once the capsule 13 surfaces, the nose cone of the capsule 13 is jettisoned to allow the missile to be launched. Once the missile 12 is launched, the capsule 13 can either remain on the surface of the water for later recovery, or sink as an expendable item.

The walls of the launch tubes 16 may preferably be lined with shock mitigation material 32 to provide shock protection for the missiles 12 and protective capsules 13. The material 32 also compensates for small structural deformations that occur during missile tube 16 construction and during normal submarine depth pressure excursions. Preferably, the material 32 is thick enough to maintain sufficient contact with the missile capsules 13 to prevent free movement, but is not so thick as to adversely restrict the missile capsule 13 from launching. A gap or clearance is preferably provided between the material and the missile capsule 13 to allow a controlled amount of water to pass ahead of the capsule 13 and assist in opening the muzzle closure 22.

In order to eject the capsules 13 from the launch tube 16, a water pump 37 is preferably supported at the bottom of the large payload pressure vessel 10, or payload bay. Pump 37 operation is preferably independent of depth pressure by ensuring the water supply and discharge points are common with the depth pressure. Thus, launch depth is only limited by the capability of the protective capsule 13. The water pump 37 preferably draws in seawater from the top of the topmost missile module 14, and pumps it underneath the capsule 13 to be ejected. Piping and valving internal to the module group may be utilized to distribute the water to the desired launch tube 16. The pressure force should be sufficient to overcome the static friction forces and to force the capsule 13 out of the launch tube 16. The lower missile capsules 13 are unaffected by the water pressure due to the seal provided at the hinged muzzle closure 22, and the latching mechanism 26 which prevents the lower missile capsules 13 from being forced downward. The pump 37 continues to operate until enough water volume has been pumped to flush or eject the capsule 13 out of the tube 16. The required water volume will be greatest for the lowest most capsule 13, and least for the upper most capsule 13, due to the relative distances each capsule 13 must travel to exit the launch tube 16. The water volumes are varied by simply varying the operating time of the pump 37. Once ejected from the tube 16, the water pump 37 may be shut off, and an inflatable airbag 13*b* can be deployed or the capsules 13 own buoyancy can be used to carry it to the surface to ascend the capsule 13 to the ocean surface, as described below. Alternatively, other known devices may be utilized to launch the missiles 12, as would be known in the art. For example, gas generators may be used in place of the water pump 37, or air flasks may be utilized, as would be known to those of skill in the art.

An expendable, inflatable underwater airbag 13*b* may be provided to give the missile capsule 13 positive buoyancy after the capsule 13 leaves the launch tube 16. The airbag 13*b* may be inflated using a small pre-charged air flask, a $CO_2$ cartridge, or a small air bag inflator/gas generator, as known in the art. As the pressurized gas is expanded, the capsule 13 floats to the water's surface. To ensure that the capsule 13 ascends vertically, the airbag 13*b* may preferably be attached to the nose cone 13*a* of the missile capsule 13.

Once on the water's surface, the nose cone 13*a* may be automatically jettisoned so the missile 12 can be launched.

Use of the underwater missile launch system will now be described with reference to the FIGURES.

Initially, each individual missile 12 is positioned within a corresponding protective capsule 13 that are then loaded vertically into the modular launch tubes 16, until the hinged portion 26*a* of the latching mechanism is engaged. Unloading may be accomplished by releasing the latching mechanism and lifting the capsules 13 back out. The entire module 14 is then lowered into the payload bay or pressure vessel 10. Keyed alignments on the outside diameter of the modules 14 may be provided to ensure the modules 14 line up with one another as they are lowered in place. In particular, alignment is needed to allow for air pipe and electrical connections between modules 14. Once properly loaded, the missiles 12 are ready for launch.

To initiate launch, the submarine should be first positioned at the desired launch depth. The volume of space under the hatch 18 of the pressure vessel 10 is then flooded, and the pressure is equalized with ambient seawater conditions. The hatch 18 of the pressure vessel 10 is then opened and the water pump 37 is activated. The water pressure is provided underneath the missile capsule 13 to be launched. The water pump 37 continues to operate until the missile capsule 13 clears the launch tube 16 of the upper module 14*b*. Once the capsule 13 is extended a sufficient predetermined distance from the muzzle 22 of the upper launch tube 16, for example, by 50%, the airbag is inflated. The missile 12 then floats to the water's surface and remains protected inside the missile capsule 13. Once on the surface, the capsule nose cone 13*a* is jettisoned. The missiles 12 own propulsion is then activated to launch the missile 12 out of the capsule 13 and to its target. The capsule 13 may either remain on the surface for recovery/reuse or sink as an expendable item.

It will be appreciated that the underwater missile launch system disclosed herein provides an effective way of launching missiles 12 from a submarine which is low in cost to construct and operate, reliable, easy to maintain, and safe. In addition, the system increases packing density that allows submarines to carry larger payloads of missiles 12. Packing densities are increased by the ability to stack the missiles 12 two or more high within the same pressure vessel 10, and by launching more than one missile 12 from the same launch tube 16 thus reducing the amount of redundant hardware required per missile 12. Sharing a common pressure vessel 10, launch tube 16, and water pump 37 also results in a significant cost and weight savings for the submarine. With increased payload packing densities, either more missiles 12 can be carried on the same size submarine or the same number of missiles 12 can be carried on a smaller submarine. The system also provides for easy loading and unloading of the missiles 12 and the missiles 12 can be loaded/unloaded individually or as an entire module 14.

It will be understood that many additional changes in the details, materials, steps and arrangement of parts, which have been herein described and illustrated in order to explain the nature of the invention, may be made by those skilled in the art within the principle and scope of the invention as expressed in the appended claims. For example, the protective capsules could be eliminated and replaced by a sabot, as would be known to those of skill in the art.

What is claimed is:

1. An underwater missile launch system for use with an underwater vehicle comprising:

a pressure vessel having an upper end and a bottom constructed and arranged to be supported on a hull of the vehicle;

at least a first module and a second module supported within said pressure vessel, the first and second modules each including a plurality of launch tubes, the second module supported on top of the first module such that the launch tubes of the second module are substantially aligned with the launch tubes of the first module, and said launch tubes having a muzzle opening positioned on a launch end of each launch tube;

a capsule configured and dimensioned to support and protect a missile and adapted to fit within one of the launch tubes; and a latching mechanism constructed and arranged to support the capsule within the launch tube at a predetermined location, the latching mechanism preventing downward movement of the capsule into the tube, while allowing for upward movement of the capsule.

2. The underwater launch system of claim 1, wherein the first and second modules have substantially the same size, shape and payload of capsules.

3. The underwater launch system of claim 1, further comprising an inflatable air bag supported on each capsule, the air bag being constructed and arranged to raise the capsule to a launch surface.

4. The missile launch system of claim 3, wherein the capsule includes a detachable nose cone, and wherein the air bag is supported on the nose cone.

5. The missile launch system of claim 1, wherein the latching mechanism includes a hinged portion supported on the capsule and a stop mechanism supported on an interior of each of the launch tubes.

6. The missile launch system of claim 5, wherein the hinged portion folds to conform to an outside diameter of the capsule.

7. The missile launch system of claim 1, further comprising a water pump supported at the bottom of the pressure vessel, the water pump constructed and arranged to provide pressurized water to the launch tubes, sufficient to eject the capsule from within the tube.

8. The missile launch system of claim 1, further comprising a movable muzzle closure disposed at the launch end of each launch tube and constructed and arranged to prevent high-pressure water build up within the launch tubes.

9. The missile launch system of claim 1, further comprising a shock mitigation material disposed within each launch tube.

10. The missile launch system of claim 1, further comprising a hatch positioned at the upper end of the pressure vessel.

11. An underwater launch system for use with an underwater vehicle comprising:

a pressure vessel having an upper end and a bottom constructed and arranged to be supported on a hull of the vehicle;

at least a first module and a second module supported within said pressure vessel, the first and second modules each including a plurality of launch tubes, the second module supported on top of the first module such that the launch tubes of the second module are substantially aligned with the launch tubes of the first module, and said launch tubes having a muzzle opening positioned on a launch end of each launch tube;

a capsule configured and dimensioned to support and protect a missile and adapted to fit within one of the launch tubes;

an inflatable airbag supported on the capsule and constructed and arranged to raise the capsule to a launch surface; and a latching mechanism constructed and arranged to support each capsule within its corresponding launch tube at a predetermined location, the latching mechanism preventing downward movement of the capsule into the tube, while allowing for upward movement of the capsule, the latching mechanism further including a hinged portion supported on the capsule and a stop mechanism supported on an interior of each of the launch tubes.

12. The underwater launch system of claim 11, wherein the first and second modules have substantially the same size, shape and payload of capsules.

13. The underwater launch system of claim 11, wherein the hinged portion of the latching mechanism folds to conform to an outside diameter of the capsule.

14. The underwater launch system of claim 11, further comprising a water pump supported at the bottom of the pressure vessel, the water pump constructed and arranged to provide pressurized water to the launch tubes, sufficient to eject the capsule from within the tube.

15. The underwater launch system of claim 11, further comprising a movable muzzle closure disposed at the launch end of each launch tube and constructed and arranged to prevent high-pressure air build up within the launch tubes.

16. The underwater launch system of claim 11, further comprising a shock mitigation material disposed within each launch tube.

17. A method of launching a missile from an underwater vehicle comprising the steps of:

providing a pressure vessel constructed and arranged to be supported on a hull of the vehicle;

providing at least one missile;

providing a first module and a second module within said provided pressure vessel, the first and second modules each including a plurality of launch tubes;

providing at least one capsule including a detachable nose cone, the at least one capsule being configured and dimensioned to support and protect a missile, and adapted to fit within one of the launch tubes;

positioning each of the at least one missiles within a corresponding protective capsule;

providing a latching mechanism constructed and arranged to support each capsule within its corresponding launch tube at a predetermined location, the latching mechanism preventing downward movement of the capsule into the tube, while allowing for upward movement of the capsule;

loading the protective capsule within one of the plurality of launch tubes until it engages the latching mechanism;

supporting the second module on top of the first module such that the launch tubes of the second module are substantially aligned with the launch tubes of the first module;

ejecting the capsule from the launch tubes;

raising the capsule to the water's surface;

jettisoning the nose cone of the capsule; and launching the missile from the capsule.

18. The method of claim 17, further comprising the steps of:

providing an air bag supported on the nose cone of the capsule; and inflating the air bag to raise the capsule to the water's surface.

19. The method of claim 17, further comprising the steps of:

providing a water pump supported within the pressure vessel; and pumping water to the launch tube of the capsule to be ejected in order to eject the capsule from the tube.

* * * * *